United States Patent [19]

Cone

[11] Patent Number: 4,766,292

[45] Date of Patent: Aug. 23, 1988

[54] REMOTELY CONTROLLED CASH BOX

[75] Inventor: Richard E. Cone, Cambridge, Ohio

[73] Assignee: NCR Corporation, Dayton, Ohio

[21] Appl. No.: 99,974

[22] Filed: Sep. 23, 1987

[51] Int. Cl.[4] ..... G07G 1/00

[52] U.S. Cl. ..... 235/22; 235/7 R; 206/0.83; 220/23; 312/211; 312/329

[58] Field of Search ..... 235/7 A, 7 R, 10, 22, 235/27, 45, 13, 15, 20, 128; 206/0.81–0.83; 220/23, 23.83, 23.86; 312/211, 246, 291, 297, 308, 324, 329, 330 R, 333

[56] References Cited

U.S. PATENT DOCUMENTS

| | | | |
|---|---|---|---|
| 436,325 | 9/1890 | Webster . | |
| 501,092 | 7/1893 | Munsell . | |
| 525,956 | 9/1894 | Lilleberg . | |
| 538,707 | 5/1895 | Smith | 235/20 |
| 750,086 | 1/1904 | Carroll . | |
| 765,747 | 7/1904 | McCormick | 235/13 |
| 861,312 | 7/1907 | Osborn | 235/10 |
| 2,145,314 | 1/1937 | Murtaugh, Jr. | 70/85 |
| 4,412,709 | 11/1983 | Ishii | 312/291 |
| 4,424,426 | 1/1984 | Ishii | 200/61.61 |
| 4,642,449 | 2/1987 | Baitz et al. | 235/22 |

*Primary Examiner*—B. R. Fuller

*Attorney, Agent, or Firm*—Wilbert Hawk, Jr.; Albert L. Sessler, Jr.; Richard W. Lavin

[57] ABSTRACT

A remotely operated cash box assembly comprises a box-like structure having a front wall portion, a rear wall portion and two side wall portions. Rotatably mounted between the front wall portion and the rear wall portion is a spring urged cover member. A solenoid actuated latch mechanism mounted to the front wall portion engages a latching surface on the cover member latching the cover member upon movement of the cover member to a position engaging the front wall portion. Energizing of the solenoid releases the cover member for movement to a position adjacent the rear wall portion opening the cash box assembly. Located within the cash box assembly is a cash tray having separate compartments for coins and bills in which the bill compartments are orientated in an upward direction to facilitate the removal and depositing of bills in the tray.

6 Claims, 4 Drawing Sheets

REMOTELY CONTROLLED CASH BOX

BACKGROUND OF THE INVENTION

The present invention relates to a cash tray or cash box and more particularly to a cash box which is remotely operated from a data terminal device. Present day merchandising checkout systems usually include an optical reader mounted in a checkout counter for reading UPC bar code labels on purchased merchandise items as part of the checkout operation. Normally the checkout operator stands adjacent the checkout counter and moves the purchased merchandise items past the optical reader. In order to relieve the checkout operator of any physical strain in moving the items past the reader, certain governmental agencies require the checkout operator to sit at the checkout counter while performing a checkout operation. This requirement restricts the amount of working area available to locate the data terminal device associated with the checkout operation. In order to solve this problem, the terminal device has been replaced by separate keyboard, display, cash drawer and printer modules, the latter two modules mounted within the checkout counter. Each module is remotely operated by a central processing unit. With the checkout operator in a sitting position, it was found that movement of the cash drawer from a closed to an open position interfered with the operator when in a sitting position.

It is therefore a principal object of this invention to provide a cash box which is convenient to use by an operator in a sitting position.

It is a further object of this invention to provide a cash box which is remotely operated to enable an operator to gain access to the cash box.

It is another object of this invention to provide a cash box with a cash tray compartment constructed to enable an operator to easily retrieve coins and bills from the compartment.

It is another object of this invention to provide a cash box which is simple in construction and therefore low in cost.

SUMMARY OF THE INVENTION

In order to fulfill these objects, there is provided a cash box comprising a box-like structure with a sliding cover member normally urged by a spring member towards an open position exposing a one-piece, two-section cash tray comprising a coin section and a bill section. The bill section comprises a multicompartment rear portion of the cash tray with each compartment orientated in a slightly upward direction thereby facilitating the insertion and removal of bills from the compartment. A solenoid locking mechanism mounted on the front wall of the cash box releases the cover member to the action of the spring member when operated by a remote processor unit. When required, the cover member is constructed to be manually moved to a closed position by the operator.

BRIEF DESCRIPTION OF THE DRAWINGS

Additional advantages and features of the present invention will become apparent and fully understood from the following detailed description and appended claims when read in conjunction with the drawings, wherein like numerals identify corresponding elements.

DESCRIPTION OF THE PREFERRED EMBODIMENT

Figure 1:
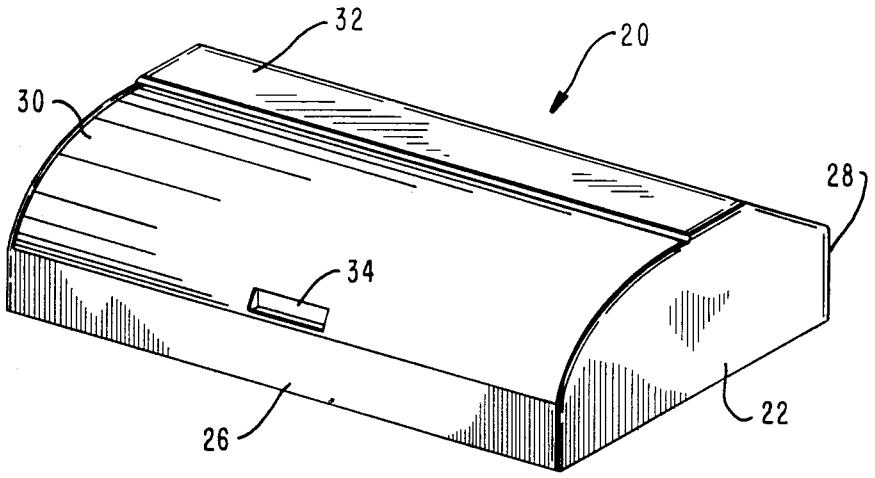
FIG. 1 is a perspective view of the cash box of the present invention shown in a closed condition.
Figure 2:
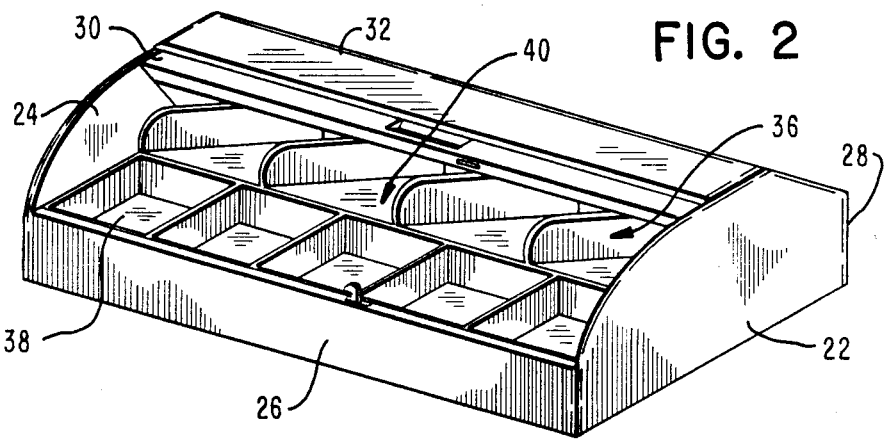
FIG. 2 is a perspective view of the cash box of the present invention shown in an open condition showing the details of the cash tray.
Figure 3:
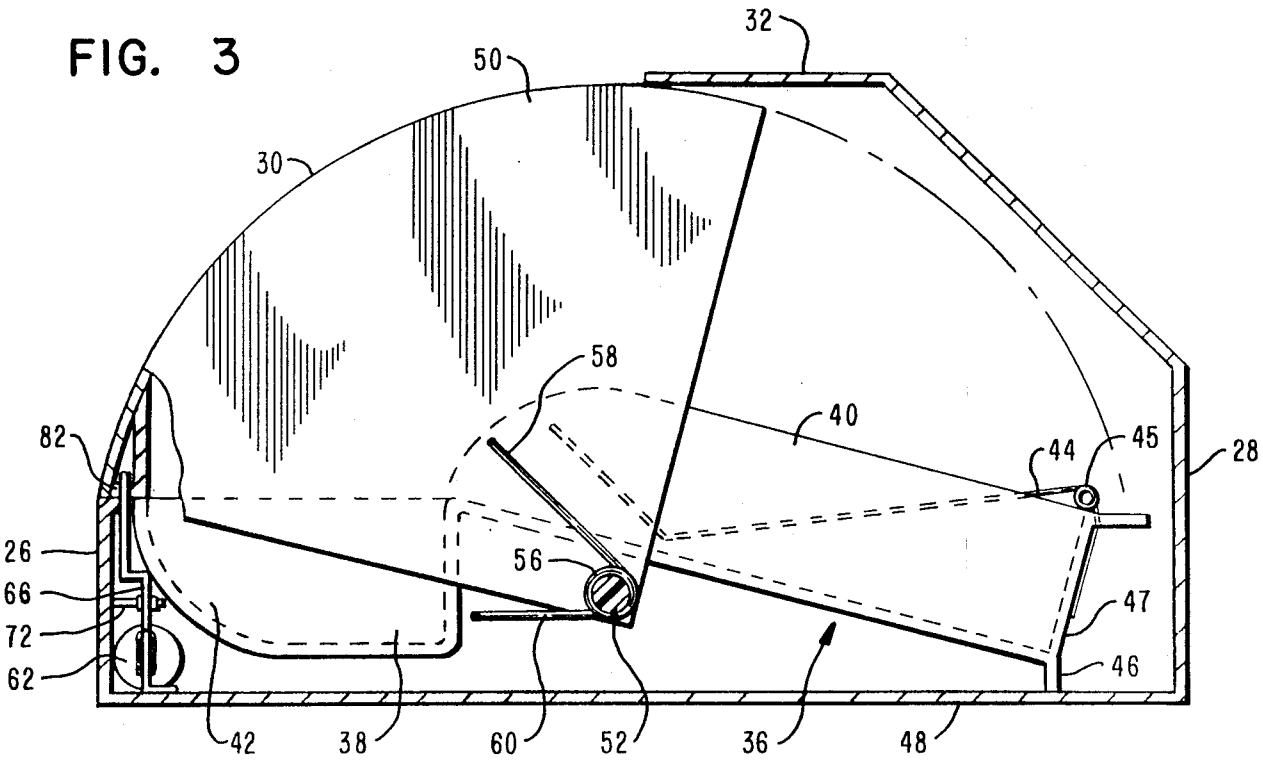
FIG. 3 is an enlarged right side view of the cash box with the right side wall and a portion of the front cover portion removed to show details of the spring member and the locking mechanism.

Referring now to FIGS. 1 and 2, there is shown a perspective view of the cash box of the present invention which comprises a boxlike structure referred to by the numeral 20 which includes sidewall portions 22 and 24 (FIG. 2), the front wall portion 26 and a rear wall portion 28 (FIG. 3). The cover of the cash box 20 comprises a rotatably mounted front cover portion 30 and a stationary rear cover portion 32 which is a continuation of the rear wall portion 28. Located in the front cover portion 30 is a recessed portion 34 forming a handle by which the operator can rotate the front cover portion 30 to a closed position as shown in FIG. 1.

As shown in FIG. 2, mounted within the cash box 20 is a cash tray generally indicated by the numeral 36 which is comprised of a unitary structure having a series of front compartments 38 formed therein which house various denominations of coins and a plurality of rear compartments 40 in which are stacked various denominations of bills in a manner that is well known in the art.

As shown in FIG. 3, the cash tray 36 comprises a unitary structure in which each of the front coin compartments 38 has a sloping front portion 42 enabling coins to be retrieved from the compartment in a relatively easy manner. Each of the rear bill compartments 40 shown in FIG. 3 is orientated in a slightly upward direction from a horizontal plane and includes a spring member 44 rotatably mounted to a support member 45 secured to the rear wall 47 of the cash tray 36 as a hold down spring for holding the bills within the compartment. The cash tray 36 is made of plastic and is molded as one piece and includes a depending leg portion 46 for mounting the cash tray on the floor portion 48 of the cash box.

Figure 4:
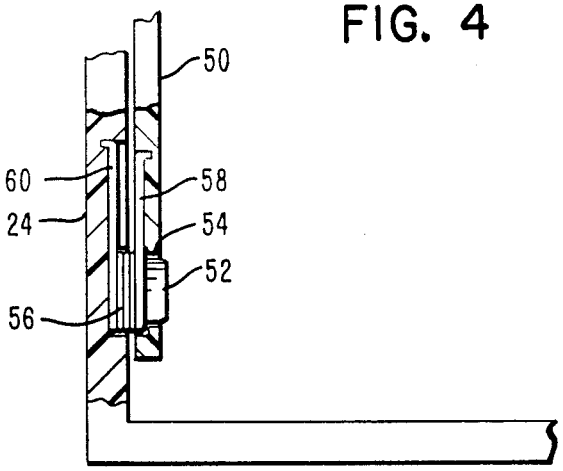
FIG. 4 is a partial detailed front view of the spring member which normally urges the rotatably mounted cover member to an open position.

The rotatably mounted front cover portion 30 includes a pair of sidewall portions 50 (FIG. 3) which are configured as an arc of a circle. Mounted within each of the sidewall portions 22 and 24 of the cash box 20 is a hub member 52 (FIGS. 3 and 4). The hub member 52 is located within an aperture 54 in each of the sidewall portions 50 of the front cover portion 30. A torsion spring 56 mounted on the hub member 52 has an arm portion 58 secured to the front cover portion 30 and a second arm portion 60 secured to the sidewall portions 22 and 24 of the cash box 20 to normally urge the front cover portion 30 in a counterclockwise direction about the hub member, as viewed in FIG. 3, to a position within the rear cover portion 32 of the cash box.

Figure 5:
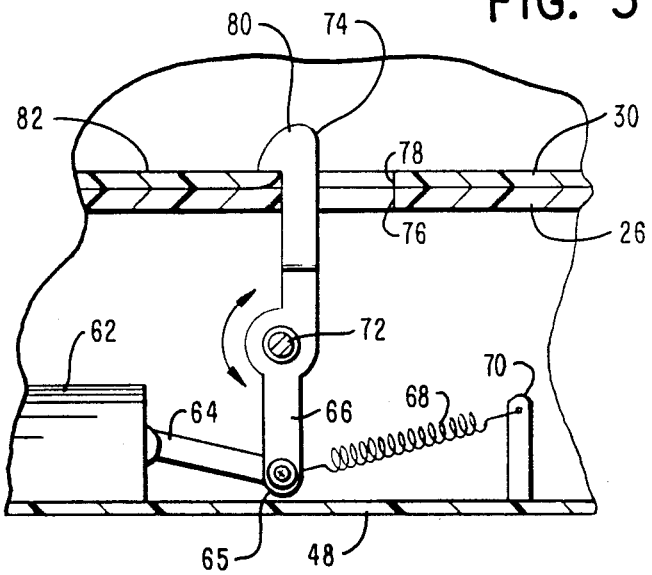
FIG. 5 is a partial detailed front view of the locking mechanism for locking the rotatable front cover portion in a closed position.

As shown in FIGS. 3 and 5, mounted on the front portion of the floor portion 48 of the cash box 20 is a solenoid 62. The solenoid 62 has an armature 64 engaging one end 65 of a lever member 66 in which the end 65 is also engaged by a spring member 68 secured to an arm member 70 mounted to the floor portion 48 of the cash box. The lever member 66 is rotatably mounted on a stud 72 (FIGS. 3 and 5) which is secured to the front wall portion 26 of the cash box. The other end of the lever member comprises a hook portion 74 which extends through a first slotted portion 76 located in the front wall portion 26 and a second slotted portion 78 located in the front cover portion 30 of the cash box when the cover portion has been moved into engagement with the front wall portion 26. The hook portion 74 has a rounded cam surface 80 which will be engaged by the edge of the slotted portion 78 when the cover portion 30 is moved towards a closed portion thereby camming the lever in a clockwise direction as viewed in FIG. 5 enabling the hook portion to engage a latching surface 82 (FIGS. 3 and 5) of the front cover portion 30 thereby locking the cover portion in a closed position under the action of the spring member 68.

Figure 6:
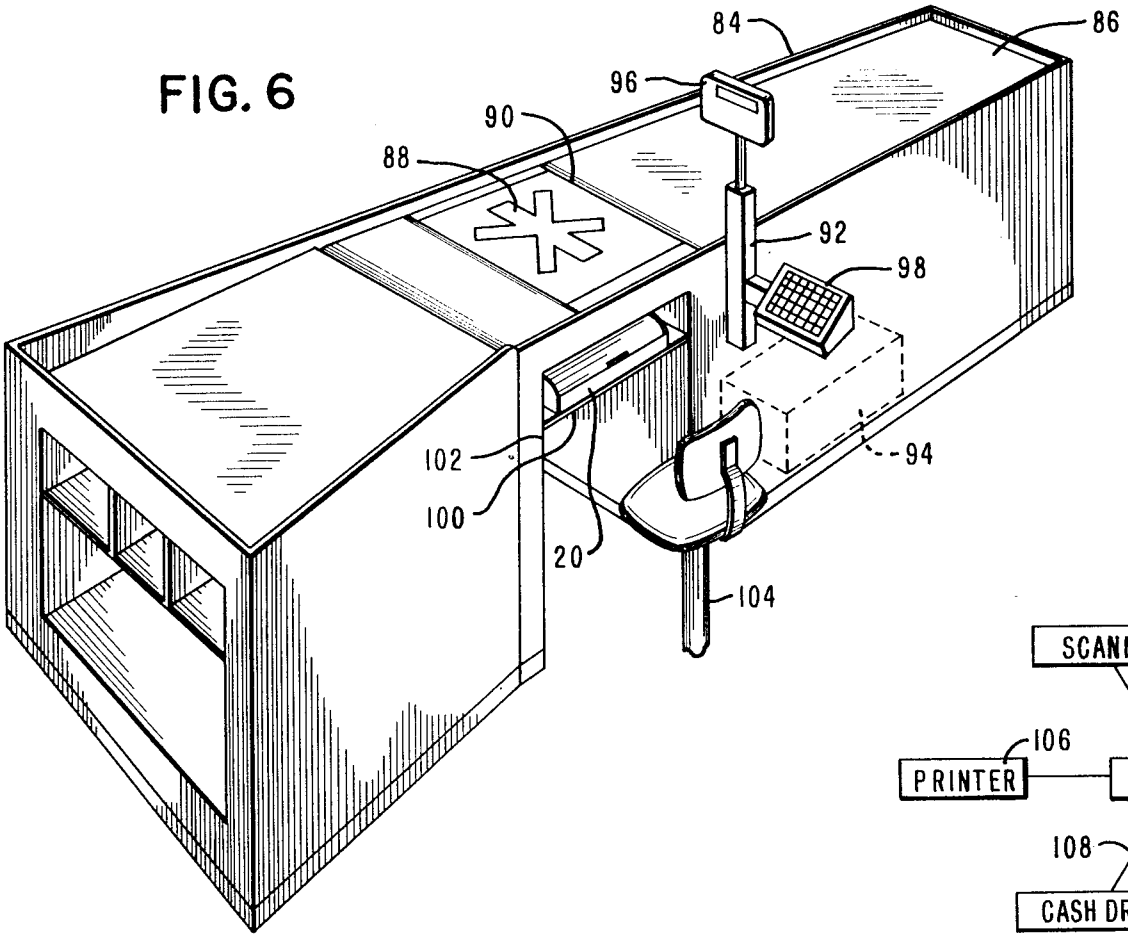
FIG. 6 is a perspective view of a checkout counter showing the location of the cash box and the various processing modules associated with the checkout counter.

Referring now to FIG. 6 there is shown a perspective view of a checkout counter 84 having a supporting surface 86 in which is located an aperture 88 through which scanning light beams of an optical scanner 90 mounted within the counter 84 are used to scan a UPC label located on a purchased merchandise item as the item is moved past the aperture 88 in a manner that is well known in the art. Mounted to a pedestal member 92 secured to the side of the checkout counter 84 is a display member 96 and a keypad member 98. Mounted within the checkout counter is a central processing unit 94 which controls the operation of the display member, the keypad member and the cash box 20 which is positioned on a shelf 100 located within a recessed portion 102 of the checkout counter. The recessed portion 102 allows a checkout operator sitting on a chair member 104 to sit at the checkout counter 84.

Figure 7:
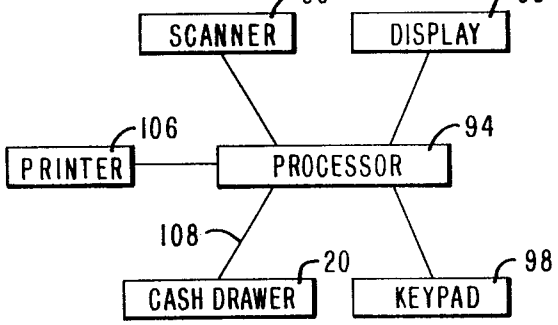
FIG. 7 is a block diagram of the checkout system of the present invention.

Referring now to FIG. 7 there is shown a block diagram of the processing system associated with the checkout operation which includes a processing unit 94 coupled to the scanner 90, the display 96, a printer 106, the cash box 20 over cable 108 and the keypad member 98. During a checkout operation, the operator sitting on the chair member 104 will move a purchased merchandise item past the aperture 88 of the scanner 90 enabling the scanner to project the scanning light beams through the aperture and read the UPC label on the merchandise item thereby generating data identifying the merchandise item. This data is transmitted to the processing unit 94 which has stored therein lookup tables for use in retrieving the price of the purchased item utilizing the data generated by the scanner 90 in scanning the UPC label. The processing unit 94 will enable the display member 96 to display the price of the merchandise item and operate the printer 106 to print on a receipt and journal member the price of each purchased item. At the completion of the merchandise transaction, the total amount due for the purchased merchandise items will be displayed on the display member 96 enabling the customer to pay the amount due.

When the transaction is completed by the customer paying the amount due, the operator, utilizing a total key (not shown) on the keypad member 98, will energize the solenoid 62 located within the cash box 20 which rotates the lever member 66 (FIG. 5) in a clockwise direction. This action releases the front cover portion 30 to the action of the spring member 56 which rotates the cover portion 30 in a clockwise direction as viewed in FIG. 3 to a position within the rear cover portion 32. At this time the operator can either obtain change from the cash tray or insert the amount tendered by the customer, whether it is in coins or bills, in the cash tray in a manner that is well known in the art. At the completion of the merchandising transaction, the operator, utilizing the recessed portion 34 (FIG. 1), will rotate the front cover portion 30 back towards a position engaging the cammed surface 80 of the lever member 66 thereby camming the lever member in a clockwise direction as viewed in FIG. 5 enabling the hook portion 74 to engage the latching surface 82 of the front cover portion 30 under the action of the spring member 68 thereby latching the front cover portion in a locked position.

It will be seen that the construction of the cash box just described allows the operator to check out merchandise items while in a sitting position without interference from the cash box when the cash box is used as part of the checkout operation.

While the principles of the invention have now been made clear in an illustrated embodiment, it will be obvious to those skilled in the art that many modifications of structure, arrangements, elements and components can be made which are particularly adapted for specific environments and operating requirements without departing from these principles. The appended claims are therefore intended to cover and embrace any such modifications, within limits only of the true spirit and scope of the invention.

I claim:

1. In a checkout system for processing purchased merchandise items including a processing means, a remotely positioned cash box assembly comprising:

a support structure having front, rear and a pair of side wall portions;

a currency receptacle mounted within said support structure having a plurality of separate coin and bill compartments;

a movable cover member rotatably mounted to said side walls, said cover member movable between a first position engaging said front wall portion and a second position adjacent said rear wall portion;

resilient means engaging said cover member normally urging said cover member towards said second position;

said cover member including a recessed portion enabling the cover member to be manually moved to said first position;

electrically operated latching means mounted to said front wall portion for latching said cover member in said first position upon movement of the cover member to said first position; and cable means interconnecting said latching means and said processing means enabling said processing means to operate said latching means whereby said latching means releases said cover member for movement to said second position under the action of said resilient means.

2. The cash box assembly of claim 1 in which said cover member includes a horizontal surface extending along the front edge of the cover member in which said horizontal surface includes a slot;

said latching means includes a rotatably mounted lever member mounted to the front wall portion of said support structure, said lever member having a latching portion positioned adjacent said slot upon movement of the cover member to said first position engaging said front wall portion; and said latching means further includes first actuating means engaging one end of said lever member for normally urging said lever member in a latching direction whereby said latching portion of the lever member will move through said slot into a position latching said cover member to said front wall portion.

3. The cash box assembly of claim 2 in which said latching means further includes electrically operated second actuating means engaging said one end of said lever member for moving said lever member in a non-latching direction when operated, said second actuating means being electrically connected to said processing means by said cable means whereby said processing means will operate said second actuating means to move said lever member to a non-latching position enabling said resilient means to move the cover member to said second position adjacent said rear wall portion.

4. The cash box assembly of claim 1 in which said resilient means comprises a torsion spring having a first arm member secured to said side wall portion and a second arm member secured to said cover member.

5. The cash box assembly of claim 1 in which the bill compartments in said currency receptacle are positioned adjacent the rear portion of the coin compartments and are orientated in a slightly upward direction towards the front wall portion of the support structure enabling bills to be easily removed or deposited upon movement of the cover member to said second position.

6. The cash box assembly of claim 3 in which said second actuating means comprises an electrically operated solenoid mounted adjacent the front wall portion of the supporting structure and having an armature member engaging said one end of the lever member for rotating the lever member to a non-latching position when operated and said first actuating means comprises a compression spring mounted between said one end of said lever member and said front wall portion for rotating said lever member to a latching position upon movement of the latching portion of the lever member moving through the slot in the horizontal surface of the cover member when the solenoid is not operative.

* * * * *